United States Patent [19]

Shaw et al.

[11] 3,949,897

[45] Apr. 13, 1976

[54] CLOSURE FOR CONTAINER

[76] Inventors: James Anthony Carpenter Shaw; Eva Shaw, both of 114 Fort Road, Oxley, Queensland, 4075, Australia

[22] Filed: Aug. 7, 1973

[21] Appl. No.: 386,359

[30] Foreign Application Priority Data

Aug. 16, 1972 Australia ..... 0097/72

[52] U.S. Cl. ..... 220/231; 220/352; 220/367; 220/373; 220/94 R; 220/DIG. 27; 220/361

[51] Int. Cl.[2] ..... B65D 51/16

[58] Field of Search..... 220/44 R, 94 R, 38.5, 72, 220/DIG. 27, 352, 361, 367, 373, 231; 229/46, DIG. 6; 215/262, 296, 355

[56] References Cited

UNITED STATES PATENTS

| | | | |
|---|---|---|---|
| 2,657,817 | 11/1953 | Alvear | 220/352 |
| 2,787,397 | 4/1957 | Radford | 220/72 |
| 2,884,151 | 4/1959 | Biederman | 220/38.5 |
| 3,080,088 | 3/1963 | Corrinet | 220/38.5 |
| 3,212,665 | 10/1965 | Duncan | 220/38.5 |
| 3,375,949 | 4/1968 | Hidding | 220/94 R |
| 3,759,416 | 9/1973 | Constantine | 220/72 |

FOREIGN PATENTS OR APPLICATIONS

| | | | |
|---|---|---|---|
| 658,794 | 4/1938 | Germany | 220/44 R |
| 843,350 | 7/1952 | Germany | 220/44 R |
| 1,086,721 | 11/1953 | France | 220/44 R |

*Primary Examiner*—William I. Price
*Assistant Examiner*—Joseph M. Moy
*Attorney, Agent, or Firm*—Donald D. Jeffery

[57] ABSTRACT

A closure to be slidably fitted in a container to exclude air from the surface of the material in said container or to be withdrawn to allow access to said material, includes a disc-like closure body, an air vent through said body, a plug to close said vent, a flexible handle attached to said body, characterized by a connection between said plug and said handle whereby force on said handle to withdraw said closure retracts said plug from said vent.

5 Claims, 3 Drawing Figures

CLOSURE FOR CONTAINER

Closures for containers have been proposed of the kind which are slidable in and seal to the inner surface of the container either to lie closely over the material in the container and exclude air therefrom, or to be retracted to enable access to that material.

To enable the closure to move into close contact with the material or away from it an air vent is necessary in the closure, while to exclude air from the material, that air vent must be closable.

It is also necessary to provide a handle by which the closure may be moved.

An object of this invention is to provide an improved combination of handle and closable air vent in such closures.

The invention comprises a slidable container closure including; a disc-like closure body; and air vent through said body; a plug to close said vent, a flexible handle for said closure attached to said body; and a connection between said handle and said plug whereby force on said handle in a direction to raise said closure retracts said plug from said vent.

The plug is preferably attached to the handle to close said vent with the handle flexed. When the handle is pulled, it first extracts the plug and, when it reaches the limit unflexed position, raises the closure.

Exemplary embodiments of the invention will be described with reference to the accompanying drawings in which.

Figure 1:
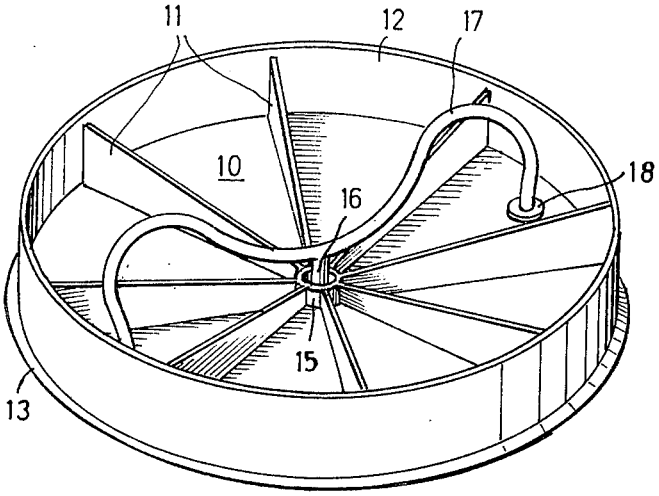
FIG. 1 shows a perspective view of one embodiment of the invention.
Figure 2:
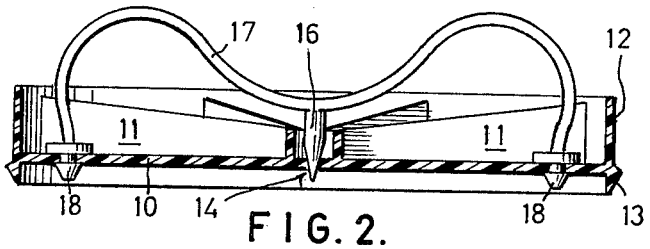
FIG. 2 shows a section of the embodiment of FIG. 1.

Referring first to FIGS. 1 and 2, the closure is formed of moulded tough resilient plastics and has a disc-like body 10 stiffened by radial ribs 11 and with an upstanding rim 12. A short depending skirt 13 seals on the body of a container (not shown) when the closure is in use.

An air vent 14 within a boss 15 centrally located on body 10 may be closed by a plug 16 or opened by removal of plug 16.

Plug 16 is carried on the centre of a flexible handle 17 which in its unstressed condition (as shown) tends to press plug 16 into vent 14.

Each end of handle 17 carries a plastic button connector 18 which may be sprung through a hole in body 10 to connect handle 17 to the body. Buttons 18 are a "snap-on" fit in the holes in body 10, so that they are easily pressed in, but more difficult to remove.

The closure is packed in small space with the handle disengaged.

In use, the handle is attached and the closure inserted in the top of the container.

With vent 14 open or only part-sealed by plug 16, the closure is pushed down expelling air through vent 14 until body 10 lies closely over the material in the container to exclude air therefrom. Plug 16 is then fully inserted in vent 14 to seal the closure. To retract the closure handle 17 is pulled upwards. As handle 17 begins to straighten under the upward force on it plug 16 is pulled from vent 14 first and then the closure moves upwards. Thus venting of the closure and its retracting are effected by a single action.

Figure 3:
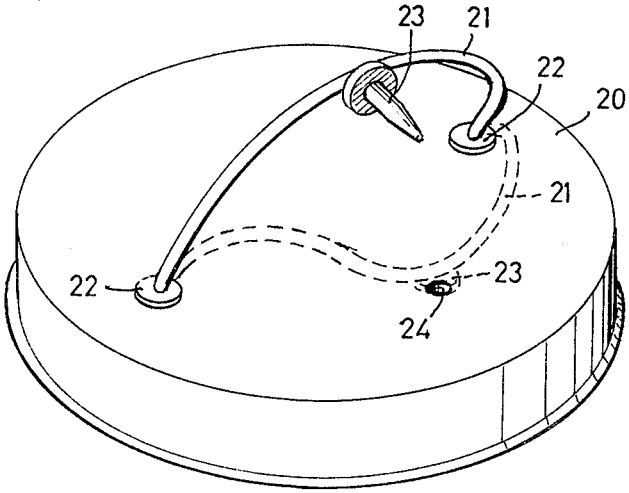
FIG. 3 shows a perspective view of another embodiment.

FIG. 3 shows a modified closure. In this case a body 20 carries a handle 21 of flexible material and arcuate shape attached to body 20 by button connectors 22 similar to buttons 18 of FIGS. 1 and 2.

A plug 23 is attached pointing transversely of the plane of handle 21 and a vent 24 is provided at a position offset from handle 21.

In use, the closure is inserted in its container and pushed down to the surface of the material in the container with plug 23 out of vent 24. The handle is then bent sideways to the position shown dotted and plug 23 inserted in vent 24 to seal the closure. To retract the closure, handle 21 is pulled upwards. This first releases plug 23 from vent 24 and, as the handle 21 reaches upright position, the closure is moved upwards.

Various changes and modifications may be made in the arrangements described without departing from the invention as claimed.

I claim:

1. A disc-like closure slidable within a container for sealing the same at a level above and adjacent to the contents of the container, including; a closure body in the form of a flat disc integrally formed with an annular peripheral rim the axis of which is perpendicular to the plane of said disc, said rim including a relatively short, downwardly depending skirt, said skirt being formed with an outer annular bead for resiliently engaging the interior of a container body for sealing the closure in the container; an air vent through said disc; a retractable plug to close said vent; a flexible handle attached to said disc to slide the closure upwards in said container; and a connection between said handle and said plug, whereby force on said handle in a direction to raise said closure first retracts said plug from said vent and subsequently raises said closure from within said container.

2. The closure of claim 1 further including a plurality of radial reinforcing ribs interconnecting said disc and said rib to reinforce the same.

3. A closure as claimed in claim 1, in which said handle includes a flexible strap, an attachment at each end of said strap to said body, said plug being fixed at an intermediate point on said strap, so that with said plug inserted in said vent said strap is flexed on each side of said plug.

4. A closure as claimed in claim 3, in which said attachments are removable.

5. A closure as claimed in claim 1, in which said handle in closure-raising position, is arcuate and upstanding from said body, said plug is attached transversely at an intermediate point on said arcuate handle, and said vent is offset from the plane of said handle, so that on said handle being flexed transversely said plug may be inserted in said vent.

* * * * *